US010865797B2

(12) United States Patent
Ji et al.

(10) Patent No.: US 10,865,797 B2
(45) Date of Patent: Dec. 15, 2020

(54) LOCAL VENTILATION EQUIPMENT AND BLOWER THEREIN

(71) Applicant: LG Electronics Inc., Seoul (KR)

(72) Inventors: Jongseong Ji, Seoul (KR); Wontae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 266 days.

(21) Appl. No.: 15/960,720

(22) Filed: Apr. 24, 2018

(65) Prior Publication Data

US 2018/0320698 A1 Nov. 8, 2018

(30) Foreign Application Priority Data

May 2, 2017 (KR) ..... 10-2017-0056572

(51) Int. Cl.
*F04D 29/62* (2006.01)
*F04D 25/06* (2006.01)
(Continued)

(52) U.S. Cl.
CPC ..... *F04D 25/0606* (2013.01); *F04D 17/162* (2013.01); *F04D 25/06* (2013.01);
(Continued)

(58) Field of Classification Search
CPC .... F04D 25/0606; F04D 17/162; F04D 25/06; F04D 29/424; F04D 29/626;
(Continued)

(56) References Cited

U.S. PATENT DOCUMENTS 5,772,176 A * 6/1998 Keck ..... H02K 5/24 248/638
8,056,352 B2 * 11/2011 Kang ..... F24F 1/0014 312/236

(Continued)

FOREIGN PATENT DOCUMENTS

DE 1204138 B 10/1965
EP 1094224 A2 4/2001

(Continued)

OTHER PUBLICATIONS

European Search Report in European Application No. 19170295.2, dated Sep. 17, 2018, 7 pages.

*Primary Examiner* — Peter J Bertheaud
*Assistant Examiner* — Dnyanesh G Kasture
(74) *Attorney, Agent, or Firm* — Fish & Richardson P.C.

(57) ABSTRACT

Disclosed herein are a local ventilation equipment and a blower therein. The local ventilation equipment includes: a main body having an intake port in a bottom and an interior area therein; and a blower installed in the interior area of the main body to generate air flow that sucks outside air into the main body through the intake port. The blower comprises an impeller that rotates on a shaft extending laterally and has therein a space to which air sucked through a side is introduced; a scroll housing that accommodates the impeller and has a suction hole formed on a side via which outside air is introduced into the space; and a driving unit that is installed in a space between the main body and the scroll hosing to supply power to rotate the impeller.

13 Claims, 9 Drawing Sheets

(51) Int. Cl.

| | |
|---|---|
| ***F04D 29/42*** | (2006.01) |
| ***F04D 17/16*** | (2006.01) |
| ***F04D 25/08*** | (2006.01) |
| ***F04D 29/28*** | (2006.01) |

(52) U.S. Cl.
CPC ..... *F04D 25/08* (2013.01); *F04D 29/281* (2013.01); *F04D 29/424* (2013.01); *F04D 29/4206* (2013.01); *F04D 29/626* (2013.01)

(58) Field of Classification Search
CPC .... F04D 29/4206; F04D 29/281; F04D 25/08; F04D 29/62
See application file for complete search history.

(56) References Cited

U.S. PATENT DOCUMENTS

| | | | | |
|---|---|---|---|---|
| 9,534,801 | B2 * | 1/2017 | Choi | F24F 5/0035 |
| 2006/0093472 | A1 | 5/2006 | Chen | |
| 2007/0059167 | A1 | 3/2007 | Hancock | |
| 2010/0234967 | A1 * | 9/2010 | Whiteley | H02K 7/116 623/24 |
| 2015/0351224 | A1 * | 12/2015 | Nii | H05K 1/05 361/711 |
| 2017/0067485 | A1 * | 3/2017 | Shelton | H02K 5/24 |

FOREIGN PATENT DOCUMENTS

| | | | |
|---|---|---|---|
| EP | 1484509 | A1 | 12/2004 |
| JP | 2016061535 | A | 4/2016 |
| WO | 2016047070 | | 3/2016 |

* cited by examiner

LOCAL VENTILATION EQUIPMENT AND BLOWER THEREIN

CROSS-REFERENCE TO RELATED APPLICATIONS

This application claims the priority of Korean Patent Application No. 10-2017-0056572 filed on May 2, 2017, in the Korean Intellectual Property Office, the disclosure of which is hereby incorporated by reference in its entirety.

TECHNICAL FIELD

The present disclosure relates to a local ventilation equipment and a blower therein, and more particularly, to a local ventilation equipment used to adjust indoor temperature and a blower therein.

BACKGROUND

Typically in a kitchen, there is a cooking table having thereon a heating appliance such as an electric heater or a gas range for cooking by applying heat to food to boil or bake it.

While heating food on the cooking table with a heating appliance, the food generates contaminants such as smoke, smell and oil vapor. These contaminants may float by heat and spread throughout the kitchen or the entire indoor space. Such spread contaminants cause an unpleasant odor to make people feel nasty. In particular, in a closed kitchen, these contaminants distract the cook and harm her/his health.

Accordingly, in a kitchen, a range hood for discharging contaminants such as smoke, smell and oil vapor generated during cooking is installed.

A range hood may include a main body that forms the exterior, a blower that generates airflow for sucking air into the main body and discharging the air to the outside of the main body, a filter that is installed in the main body to filter the air sucked into the main body, and a pipe or duct that forms a passage for discharging the air sucked into the main body through the filter.

The blower included in the range hood is installed in the main body and may be divided into a centrifugal blower and an axial blower depending on the angle between the direction of air transfer and the impeller shaft.

Among them, the centrifugal blower uses centrifugal force and has an impeller located in a scroll housing. In such a centrifugal blower, the flow at the inlet of the impeller is in parallel with the rotation shaft while the flow at the outlet of the impeller is perpendicular to the rotation shaft.

When the impeller rotates, the impeller can generate air flow. The air flow generated by the impeller is guided along the inner wall of the scroll housing and then discharged through the outlet.

Such a centrifugal blower may be classified into a multi-bladed blower, a turbo blower, a plate blower, etc. depending on the structure of the impeller.

Such a centrifugal blower may be employed by a variety of appliances, such as a range hood and an air conditioner, so that it flows the air.

In the range hood employing the centrifugal blower, the centrifugal blower may have intake ports on both sides of a scroll housing having an impeller therein and have an outlet duct formed on the top of the scroll housing. This type of centrifugal blower may be a double-inlet centrifugal blower that sucks and blows in two directions.

The centrifugal blower is installed in the space surrounded by the main body. The size of the main body of the range hood may be determined based on the volume occupied by the centrifugal blower. That is, a compact range hood can be implemented by reducing the volume occupied by the centrifugal blower.

The centrifugal blower is provided with a motor for providing power for rotating the impeller. Typically, the motor is installed in the space inside the impeller to reduce the volume occupied by the centrifugal blower.

However, when the motor is installed in the impeller, the shape and size of the motor employed by the centrifugal blower are limited by the size of the impeller.

That is, in order to be employed by the centrifugal blower, a motor has to be produced so that it has a shape and a size that do not cause interference between the motor and the impeller when the motor is inserted into the impeller. Otherwise, the motor cannot be employed by the centrifugal blower.

Therefore, in order to employ a new motor different from existing motors to a centrifugal blower, it is required to alter the shape and size of the motor so that it can be inserted into the impeller.

That is, even though a new motor is thinner and lighter and provides lower noise and higher power than existing motors employed by a centrifugal blower, if the new motor may cause interference between the motor and the impeller when it is installed in the impeller, it may require a great amount of time and cost for altering the design of the motor, or it may be even impossible to employ the motor to the centrifugal blower. If interference between the motor and the impeller is concerned when the motor is installed inside the impeller, it is necessary to invest a lot of time and money for design change or it may become impossible to apply centrifugal blower of the motor at all.

SUMMARY

It is an object of the present disclosure to provide a local ventilation equipment and a blower therein with improved structure in which a type of motor manufactured for general purpose is compatible without any additional design change.

It is another object of the present disclosure to provide a local ventilation equipment and a blower therein with improved suction performance.

In accordance with one aspect of the present disclosure, a local ventilation equipment includes: a main body having an intake port in a bottom thereof and an interior area therein; and a blower installed in the interior area of the main body to generate air flow that sucks outside air into the main body through the intake port, wherein the blower comprises an impeller that rotates on a shaft extending laterally and has therein a space to which air sucked through a side is introduced; a scroll housing that accommodates the impeller and has a suction hole formed on a side via which outside air is introduced into the space; and a driving unit that is installed in a space between the main body and the scroll hosing to supply power to rotate the impeller.

The driving unit may be configured such that a rotor and a stator are mounted in a motor case and a shaft connects between the impeller and the rotor, and the driving unit comprises a BLDC motor, a length of the motor case in a width direction being smaller than a width of the gap between the main body and the scroll housing.

The blower may further include a mounting portion provided on a side of the scroll housing on which the suction hole is formed, and the driving unit may be coupled with the mounting portion and is installed outside the scroll housing.

The driving unit may be installed spaced apart from an outer circumferential surface of the scroll housing so that a passage connecting the intake port with the suction hole is formed between the driving unit and the scroll housing.

In accordance with another aspect of the present disclosure, a blower includes: an impeller that rotates on a shaft extending laterally and has therein a space to which air sucked through a side is introduced; a scroll housing that has a space for accommodating the impeller and has a suction hole formed on a side via which outside air is introduced into the space; a mounting portion provided on a side of the scroll housing where the suction hole is formed; and a driving unit that is coupled with the mounting portion to be installed outside the scroll housing.

The scroll housing may be formed in a laid cylindrical shape with sides opened, wherein the mounting portion comprises a plurality of support members arranged along a circumference of the scroll housing, spaced apart from one another at a spacing, each of the support members may have a length extending from an outer circumferential surface of the scroll housing toward a center of the suction hole, and the driving unit may be coupled with the plurality of support members at a position closer to the center of the suction hole from the outer circumferential surface of the scroll housing.

The driving unit may be installed spaced apart from the outer circumferential surface of the scroll housing so that a passage connecting the suction hole to outside of the blower is formed between the driving unit and the scroll housing.

The driving unit may be configured such that a rotor and a stator are mounted in a motor case and a shaft connects between the impeller and the rotor, wherein the driving unit may include a BLDC motor, a length of the motor case in a width direction being smaller than a length of a part of the shaft that protrudes from the motor case.

According to an exemplary embodiment of the present disclosure, a driving unit is installed outside an impeller and thus there is no possibility that the driving unit interferes with the impeller. Accordingly, it is possible to employ a type of driving unit manufactured for general purpose for various types of blowers having different sizes of the impeller without any additional design change.

According to another exemplary embodiment of the present disclosure, by employing a type of driving unit manufactured for general purpose for various types of blower having different sizes of the impeller without any additional design change, it is possible to save time and cost invested for the design change of the motor and to improve the compatibility of the motor for blowers.

In addition, according to an exemplary embodiment of the present disclosure, the driving unit is not installed inside the impeller, and the passage having a sufficient width is formed between the driving unit and the scroll housing, thereby reducing noise and vibration while improving suction performance.

BRIEF DESCRIPTION OF DRAWINGS

Like reference numbers and designations in the various drawings indicate like elements.

DETAILED DESCRIPTION

Figure 1:
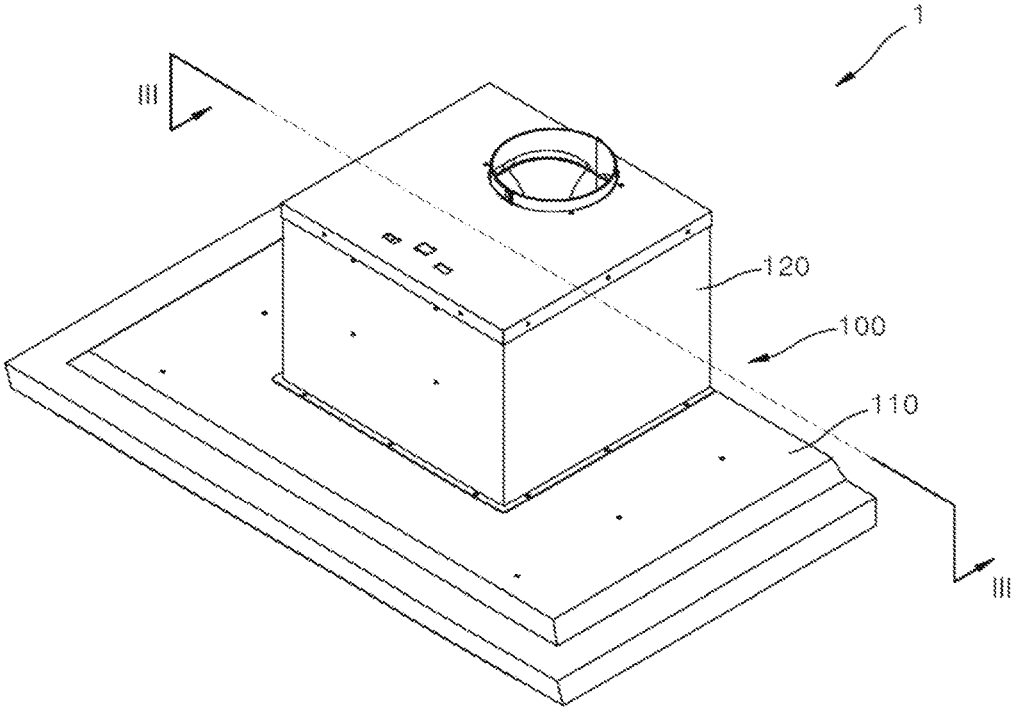
FIG. 1 is a perspective view of a local ventilation equipment according to an exemplary embodiment of the present disclosure.

Hereinafter, a local ventilation equipment and a blower therein according to an exemplary embodiment of the present disclosure will be described with reference to the accompanying drawings. In the drawings, the thickness of lines or the size of the elements may be exaggerated and not drawn on scale for the purposes of clarity and convenience. In the following description, the terms or words used in the specification and claims shall not be construed merely in a conventional and dictionary definition but shall be construed in a meaning and concept corresponding to the technical idea of the present disclosure based on the principle that an inventor is allowed to properly define the concepts of terms in order to describe his or her invention in the best way.

Figure 2:
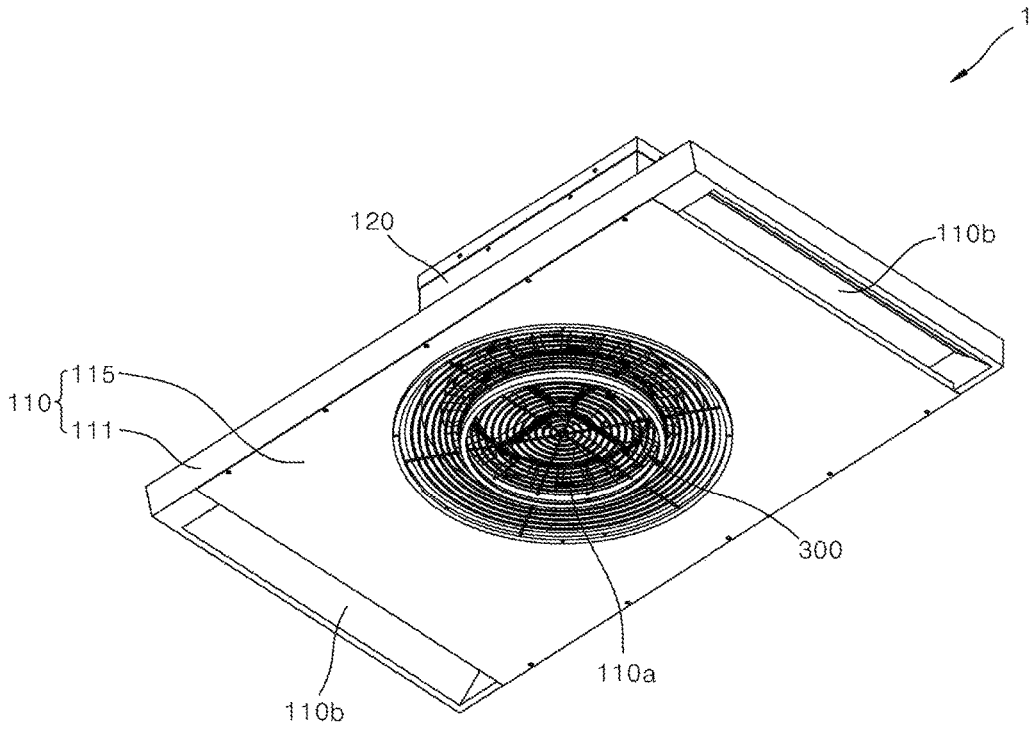
FIG. 2 is a perspective view of the local ventilation equipment shown in FIG. 1 when viewed from below.
Figure 3:
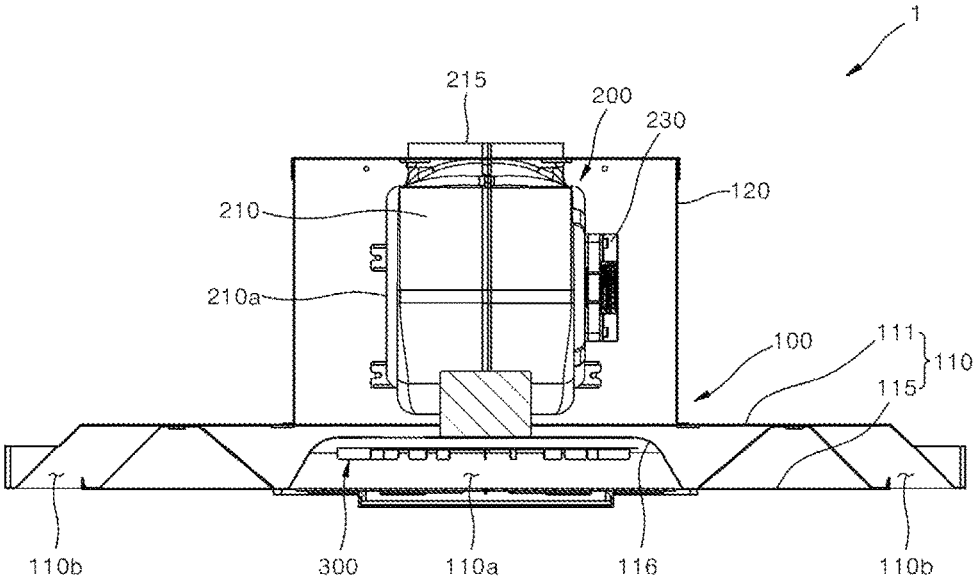
FIG. 3 is a cross-sectional view taken along line III-III" of FIG. 1.

FIG. 1 is a perspective view of a local ventilation equipment according to an exemplary embodiment of the present disclosure. FIG. 2 is a perspective view of the local ventilation equipment shown in FIG. 1 when viewed from below. FIG. 3 is a cross-sectional view taken along line III-III" of FIG. 1.

Referring to FIGS. 1 to 3, a local ventilation equipment 1 according to an exemplary embodiment of the present disclosure includes a main body 100 and a blower 200.

The main body 100 forms the exterior of the local ventilation equipment 1 according to the exemplary embodiment of the present disclosure and may include a lower housing 110 and an upper housing 120.

The lower housing 110 is disposed at a lower portion of the main body 100 and has a space for allowing air sucked through intake ports 110*a* and 110*b* to flow therein. In this embodiment, the lower housing 110 is illustrated as being formed in a flat box shape having the length and width larger than the height.

In the bottom of the lower housing 110 formed as described above, the intake ports 110*a* and 110*b* are formed. The intake ports 110*a* and 110*b* are formed by penetrating the bottom of the lower housing 110 so that they form passages for allowing the outside air to be sucked into the space inside the lower housing 110.

In the exemplary embodiment, the intake ports 110*a* and 110*b* are illustrated as including a main intake port 110*a* and auxiliary intake ports 110*b*.

The main intake port 110*a* is disposed at the center in the width direction of the lower housing 110 so that a passage for sucking the outside air into the space inside the lower housing 110 is formed at the center in the width direction of the lower housing 110.

The auxiliary intake ports 110*b* are disposed on both sides of the lower housing 110 in the width direction, respectively. Each of the auxiliary inlets 110*b* is spaced apart from the main intake port 110*a* by a predetermined distance along the width direction of the lower housing 110 so that the passage for sucking the outside air into the space inside the lower housing 110 is formed on either side in the width direction of the lower housing 110.

Thus, the local ventilation equipment 1 according to the exemplary embodiment of the present disclosure can suck air not only around the main intake port 110*a* but also around the auxiliary intake ports 110*b*, and thus it can capture contaminants effectively over a larger area to discharge them.

According to the exemplary embodiment of the present disclosure, in the lower housing 110 a suction duct 111 and a bottom panel 115 are coupled with each other in the vertical direction.

The suction duct 111 is provided in the form of a flat box with its lower surface opened. The bottom panel 115 is coupled to the opened lower surface of the suction duct 111. On the inner side of the suction duct 111, a space is formed that is surrounded by the suction duct 111 and the bottom panel 115. The upper housing 120 is connected to the upper portion of the suction duct 111. The connecting portion between the suction duct 111 and the upper housing 120 is opened, such that the inside of the lower housing 110 is connected to the inside of the upper housing 120.

The bottom panel 115 is coupled to the opened lower portion of the suction duct 111 to form the bottom surface of the lower housing 110. The bottom panel 115 has a length in the width direction shorter than that of the suction duct 111, and is installed under the suction duct 111 such that the center of the bottom panel 115 in the width direction is located at the center of the suction duct 111 in the width direction. Accordingly, a gap is formed between the end portion of the bottom panel 115 in the width direction and the end portion of the suction duct 111 in the width direction. The gaps formed on both sides of the lower housing 110 in the width direction may form the auxiliary intake ports 110*b*, respectively.

A groove 116 is formed in the bottom panel 115. The groove 116 is recessed inwardly of the lower housing 110 at a substantially center of the bottom panel 115. The main intake port 110*a* is formed in the groove 116 so that it penetrates in the vertical direction.

The upper housing 120 is disposed at the upper portion of the main body 100, and an interior area is formed in the upper housing 120. In this embodiment, the upper housing 120 is illustrated as being formed in the shape of a box having an open bottom. The opened bottom of the upper housing 120 is connected to the opened top of the lower housing 110 so that the air sucked through the lower housing 110 can flow into the interior area inside the upper housing 120.

In addition, in the interior area inside the upper housing 120, the blower 200 is installed. The blower 200 is installed in the interior area inside the upper housing 120, that is, inside the main body 100, and forms an air flow for sucking the outside air into the main body 100 through the intake ports 110*a* and 110*b*. The detailed configuration and operation of the blower 200 will be described later.

The local ventilation equipment 1 according to the exemplary embodiment of the present disclosure may further include a vortex generator 300. The vortex generator 300 is installed in the main body 100, specifically in the lower housing 110 and generates vortex around the intake ports 110*a* and 110*b* so that the outside air is sucked into the main body 110 through the intake ports 110*a* and 110*b*

Figure 4:
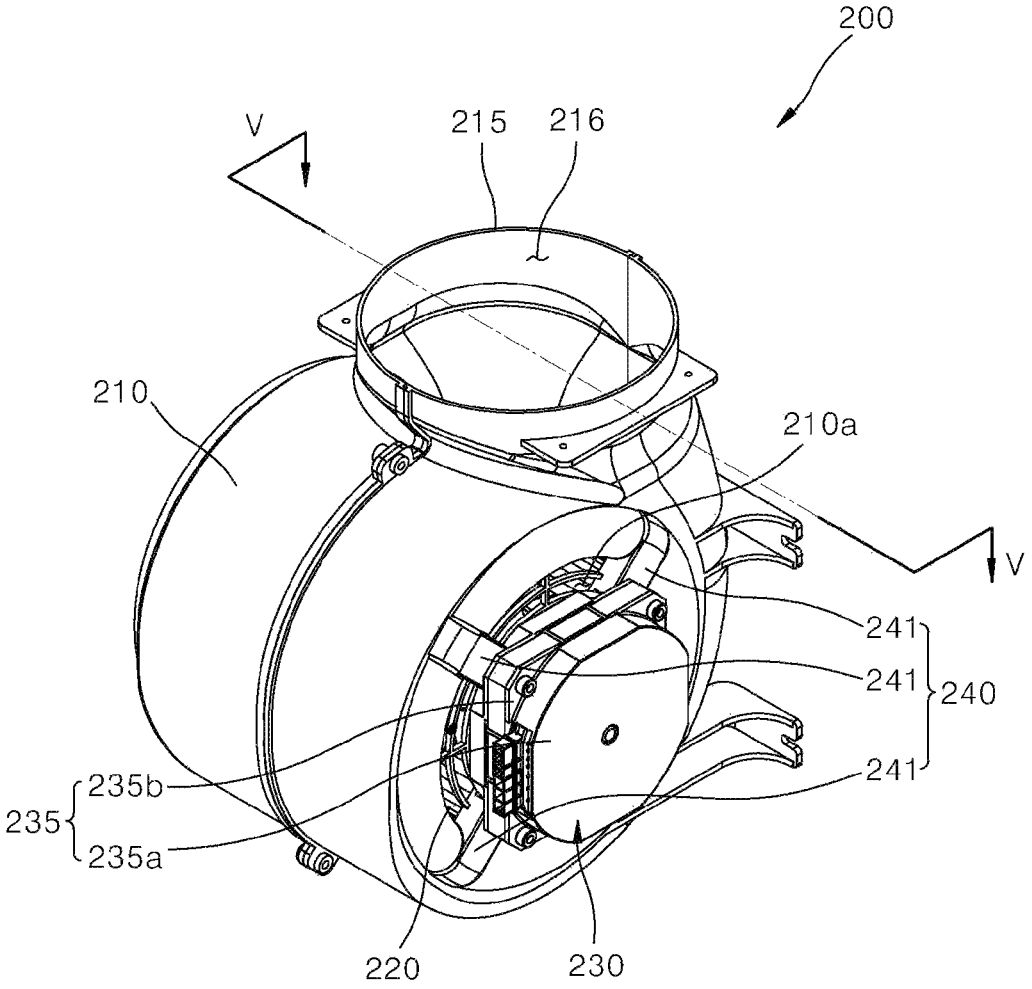
FIG. 4 is a perspective view of the blower shown in FIG. 1 separated from the local ventilation equipment.
Figure 5:
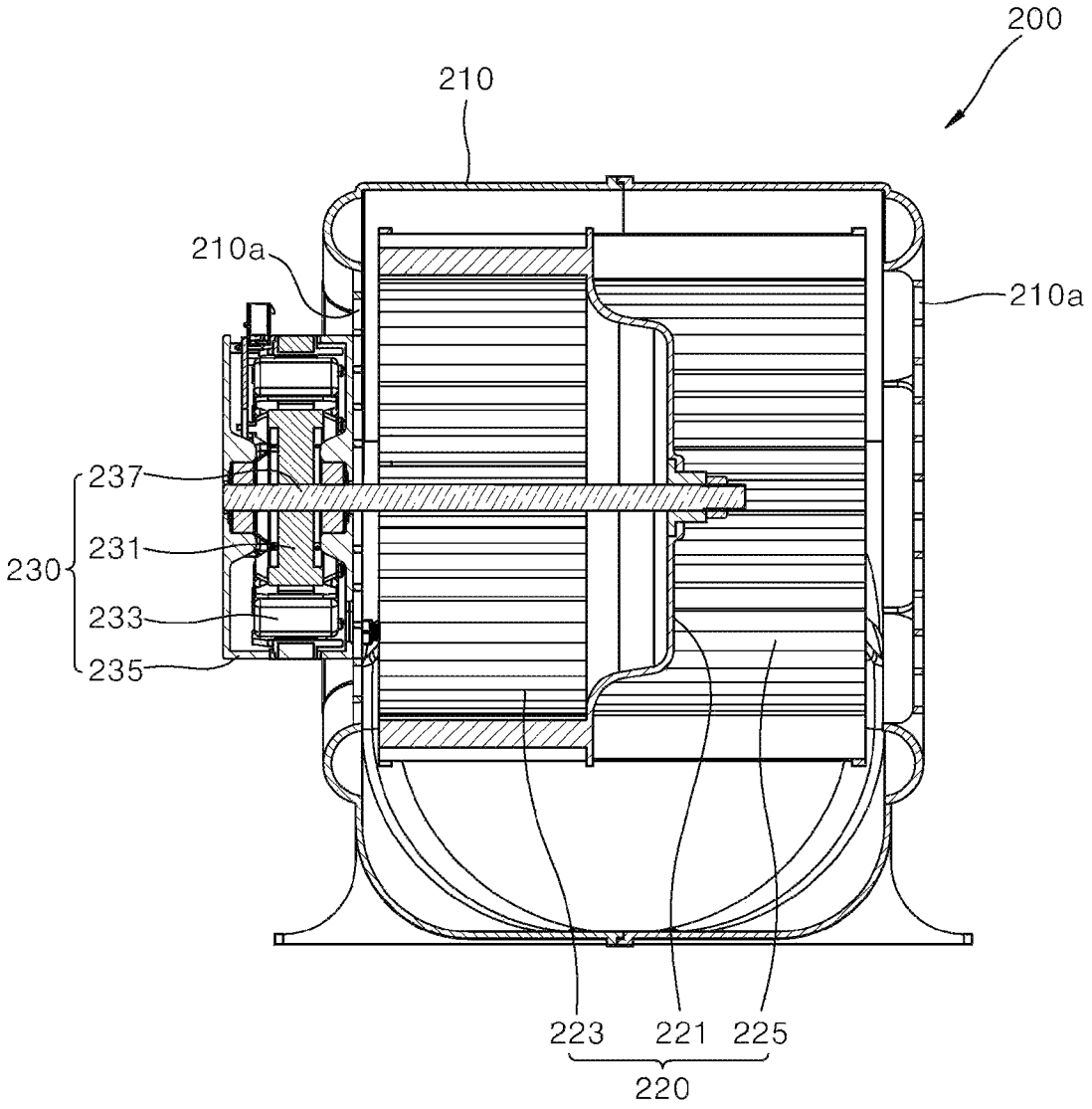
FIG. 5 is a cross-sectional view taken along line V-V shown in FIG. 4.

FIG. 4 is a perspective view of the blower shown in FIG. 1 separated from the local ventilation equipment. FIG. 5 is a cross-sectional view taken along line V-V shown in FIG. 4.

Referring to FIGS. 4 and 5, the blower 200 may include a scroll housing 210, an impeller 220 and a driving unit 230.

The scroll housing 210 forms the exterior of the blower 200, and a suction hole 210*a* is formed on a side of the scroll housing 210 to form a passage through which outside air is sucked into the impeller 220. The suction hole 210*a* is formed on either side of the scroll housing 210. The suction hole 210*a* works as a passage via which the blower 200 sucks air from its both sides.

According to the exemplary embodiment of the present disclosure, the scroll housing 210 is formed in a shape including a laid cylindrical shape with both sides open, and the side surfaces of the scroll housing 210 work as the suction holes 210*a*.

The interior area for accommodating the impeller 220 is formed in the scroll housing 210. The inner circumferential surface of the scroll housing 210 facing the interior area is formed as a curved surface surrounding the outer circumferential surface of the impeller 220.

An outlet 215 is formed at the top of the scroll housing 210. Inside the outlet 215, an exhaust hole connected to the interior area in the scroll housing 210 is formed. The exhaust hole forms a passage via which the air sucked into the interior area where the impeller 220 is accommodated is discharged to the outside.

The outlet 215 may protrude from the main body 100 such that it penetrates the upper housing 120 upwardly, and may be connected to an external duct (not shown) outside the main body 100. The air sucked into the interior area where the impeller 220 is accommodated can be discharged to the outside through the exhaust hole formed in the exhibit vent 215 and the external duct connected to it The impeller 220 is disposed such that it can rotate on the shaft extending laterally. Inside the impeller 220, a space is formed into which air sucked through the side of the impeller 220 flows.

The impeller 220 includes a hub 221 having a rotation shaft connection part to which the rotation shaft of a motor provided in the driving unit 230 is connected. The impeller 220 connected to the rotation shaft of the motor provided in the driving unit 230 through the hub 221 is rotatable on the shaft extending laterally.

In addition, the impeller 220 may further include a first blade 223 formed on one side of the hub 221, i.e., the left hand of the hub 221, and a second blade 225 formed on the other side of the hub 221, i.e., the right hand of the hub 221.

The impeller 220 may include a turbo fan, a sirocco fan, or the like. When the impeller 220 includes a turbo fan, the first blade 223 and the second blade 225 may be configured as backward-curved blades of a turbo fan. When the impeller 220 includes a sirocco fan, the first blade 223 and the second blade 225 may be configured as multi-blade of a sirocco fan.

The first blade 223 may be installed such that it is positioned between the left side surface of the hub 221 and the left side surface of the scroll housing 210 and spaced apart from the left side surface of the scroll housing 210. In addition, the second blade 225 may be installed such that it is positioned between the right side surface of the hub 221 and the right side surface of the scroll housing 210 and spaced apart from the right side surface of the scroll housing 210.

The driving unit 230 supplies power for rotating the impeller 220. The driving unit 230 may include a rotor 231 serving as a rotating part of the motor, a stator 233 serving as a stationary part of the motor, a motor case 235 forming the exterior of the motor and accommodating the rotor 231 and the stator 233 therein, and a shaft 237 rotated with the rotor 231. The driving unit 230 may be connected to the impeller 220 by coupling the shaft 237 with the hub 221. Accordingly, the power generated by the driving unit 230 can be transmitted to the impeller 220 through the shaft 237 and the hub 221, so that the impeller 220 can be rotated.

The driving unit 230 is installed in the scroll housing 210 such that it is disposed in a gap between the main body 100 and the scroll housing 210. The driving unit 230 includes the rotor 231 and the stator 233 installed in the motor case 235, such that the shaft 237 connects the impeller 220 to the rotor 231. The driving unit 230 includes a brushless direct current motor (BLDC) that has no brush and windings disposed in the stator 233.

In the BLDC motor, the length of the motor case 235 in the width direction is shorter than the length of a part of the shaft that protrudes from the motor case 235.

The length of the motor case 235 of the BLDC motor in the width direction is much shorter than the length of other elements of the blower 200 in the width direction, e.g., the scroll housing 210 or the impeller 220.

The BLDC motor thus provided is configured such that the length of the motor case 235 in the width direction is shorter than the width of the gap between the upper housing 120 of the main body 100 and the scroll housing 210 of the blower 200.

That is, the BLDC motor can has a sufficiently small size so that it can be disposed in the gap between the upper housing 120 and the scroll housing 210 that is significantly narrower than the length of the blower 200 in the width direction.

The driving unit 230 including the above-described BLDC motor is installed outside the scroll housing 210 not in the space in the impeller 200, so that it is disposed in the gap between the upper housing 120 and the scroll housing 210.

Since the driving unit 230 is installed outside the scroll housing 210 without being inserted into the impeller 220 such that it is disposed in the gap between the upper housing 120 and the scroll housing 210, it is possible to easily install the driving unit 230 in the main body 100 without increasing the width of the main body 100 or altering the shape of the main body 100.

That is, in the local ventilation equipment 1 according to the exemplary embodiment of the present disclosure, there is no need to alter the design of components such as the main body 100 or add other components to change the installation position of the driving unit 230, and thus the driving unit 230 can be installed outside the scroll housing 210 without any additional process or cost.

The blower 200 may further include a mounting portion 240.

The mounting portion 240 is to fix the driving unit 230 to the scroll housing 210 and is formed on the side of the scroll housing 210 where the suction hole 210*a* is formed.

According to the exemplary embodiment of the present disclosure, the scroll housing 210 is formed in a laid cylindrical shape with both sides open, and the side surfaces of the scroll housing 210 are formed in a circular shape. The mounting portion 240 is provided on the side of the scroll housing 210. The mounting portion 240 may be provided only on one side or either side of the scroll housing 210. In this exemplary embodiment, the mounting portion 240 is provided on only one side of the scroll housing 210.

Figure 6:
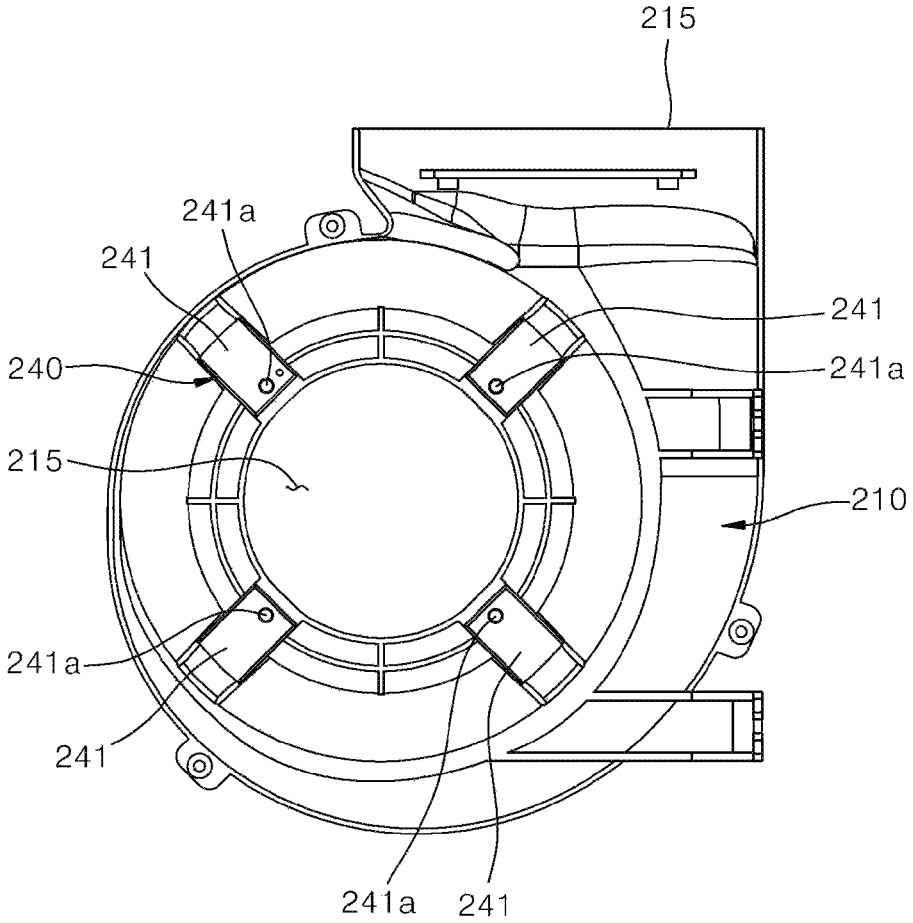
FIG. 6 is a side view showing the exterior of a part of the scroll housing shown in FIG. 4.
Figure 7:
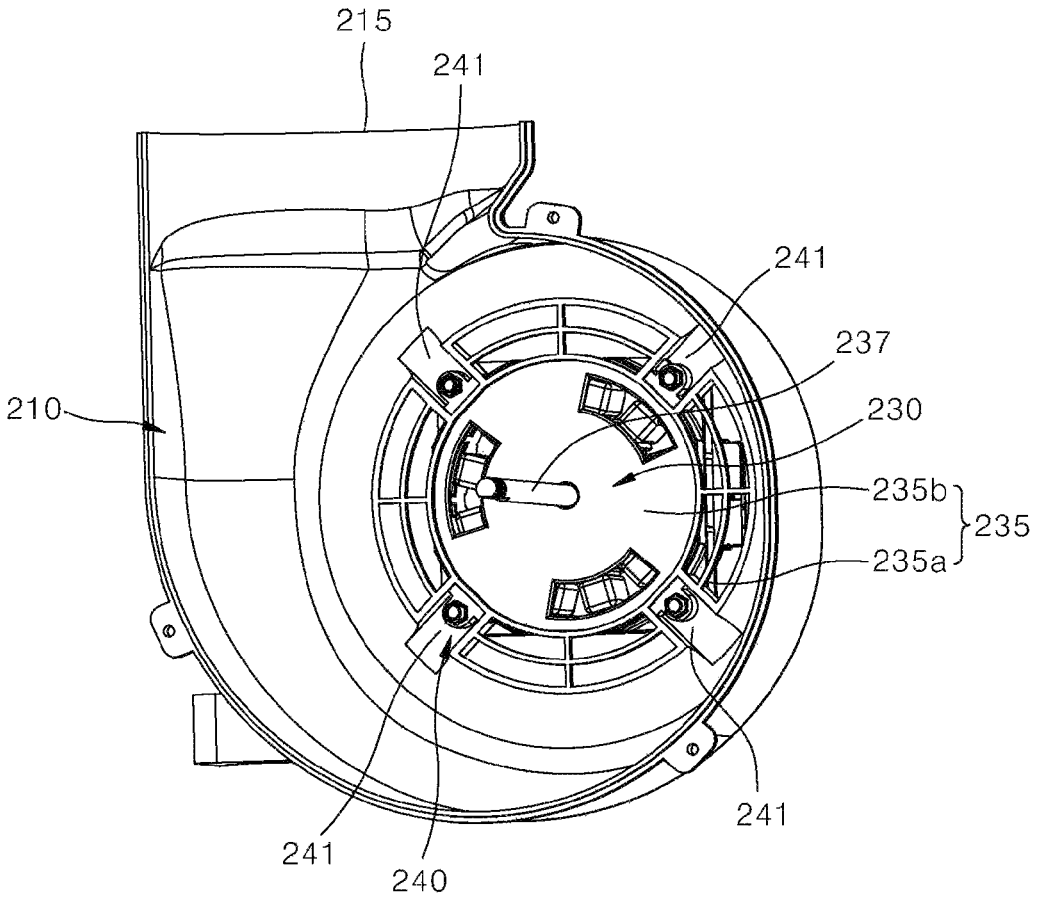
FIG. 7 is a side view showing the interior of a part of the scroll housing shown in FIG. 4 with the driving unit coupled with it.

FIG. 6 is a side view showing the exterior of a part of the scroll housing shown in FIG. 4. FIG. 7 is a side view showing the interior of a part of the scroll housing shown in FIG. 4 with the driving unit coupled with it.

Referring to FIGS. 5 to 7, the mounting portion 240 may include a plurality of support members 241. Specifically, the plurality of support members 241 of the mounting portion 240 may be disposed on the side of the scroll housing 210 along the circumference of the side of the scroll housing 210 at a predetermined spacing.

In this embodiment, four support members 241 are arranged at equal spacing along the circumference of the side of the scroll housing 210 on the side of the scroll housing 210. Each of the support members 241 may be formed as a plate or rod having a length extending from the outer circumferential surface of the scroll housing 210 toward the center of the scroll housing 210. For example, the mounting portion 240 may have four support members 241 arranged in x-shape on the side of the scroll housing 210.

The driving unit 230 is coupled with the mounting portion 240, such that the driving unit 230 can be installed outside the scroll housing 210.

The mounting portion 240 may be coupled with the driving unit 230 by coupling between the motor case 235 of the driving unit 230 and the supporting members 241 of the mounting portion 240.

According to the exemplary embodiment of the present disclosure, the motor case 235 includes a case body 235*a* and coupling parts 235*b*.

The case body 235*a* occupies the majority of the exterior of the motor case 235 and accommodates the rotor 231 and the stator 233 therein. The case body 235*a* may be in a flat cylindrical shape disposed at the center of the motor case 235.

The coupling parts 235*b* are provided around the case body 235*a* and are to couple the case body 235*a* with the mounting portion 240. The coupling parts 235*b* are extended from the case body 235*a* in the back-and-forth or vertical direction so as to be disposed at corners of the motor case 235 so that it is disposed outside the case body 235*a* disposed at the center of the motor case 235.

That is, the motor case 235 is formed as a flat box as a whole, and the flat cylindrical case body 235*a* is disposed at the center and the coupling parts 235*b* are formed at four corners on the outer side thereof. The four corners of the motor case 235 formed by the coupling parts 235*b* have the length in the width direction shorter than the center portion of the motor case 235 formed by the case body 235*a*, that is, thinner than the center portion of the motor case 235 formed by the case body 235*a*.

In each of the coupling parts 235*b*, a fastening hole is formed so as to penetrate in the width direction of the motor case 235, that is, the thickness direction of the engaging parts 235*b*. Also, a fastening hole 241*a* is formed in each of the support members 241 so as to penetrate in the same direction as the fastening holes in the coupling parts 235*b*.

For example, the coupling parts 235*b* may be coupled with the support members 241 by aligning the scroll housing 210 with the driving unit 230 so that the fastening holes of the coupling parts 235*b* overlap with the fastening holes 241 of the support members 241 and inserting bolts into the fastening holes, respectively, to fix the bolts with nuts.

As described above, the coupling parts 235*b* are coupled with the support members 241 at four positions, such that the driving unit 230 can be coupled with the housing 210.

As the parts 235*b* are coupled with the support members 241 at positions closer to the center of the suction hole 210*a* from the outer circumferential surface of the scroll housing 210.

According to the exemplary embodiment of the present disclosure, the driving unit 230 occupies a smaller area than the suction hole 210*a* so that it cannot hide the suction hole 210*a* on the outer side of the scroll housing 210 when viewed from the side.

In addition, the fastening holes of the support members 241 are formed at positions closer to the center of the suction hole 210*a* from the outer circumferential surface of the scroll housing 210, and accordingly the fastening holes of the coupling parts 235*b* are also formed at the corresponding positions, such that the coupling parts 235*b* and the support members 241 are coupled with each other at the positions closer to the center of the suction holes from the outer circumferential surface of the scroll housing 210.

As the coupling parts 235*b* are coupled with the support members 241 in this manner, the driving unit 230 is coupled with the mounting portion 240 at a position closer to the center of the suction hole 210*a* from the outer circumferential surface of the scroll housing 210.

As a result, the driving unit 230 can be installed spaced apart from the outer circumferential surface of the scroll housing 210 by a certain spacing, so that a passage connecting the suction hole 210*a* to the outside of the blower 200, i.e., a passage connecting between the suction holes 110*a* and 110*b* of the main body 100 and the suction hole 210*a* of the scroll housing 210 is formed between the driving unit 230 and the scroll housing 210.

Figure 8:
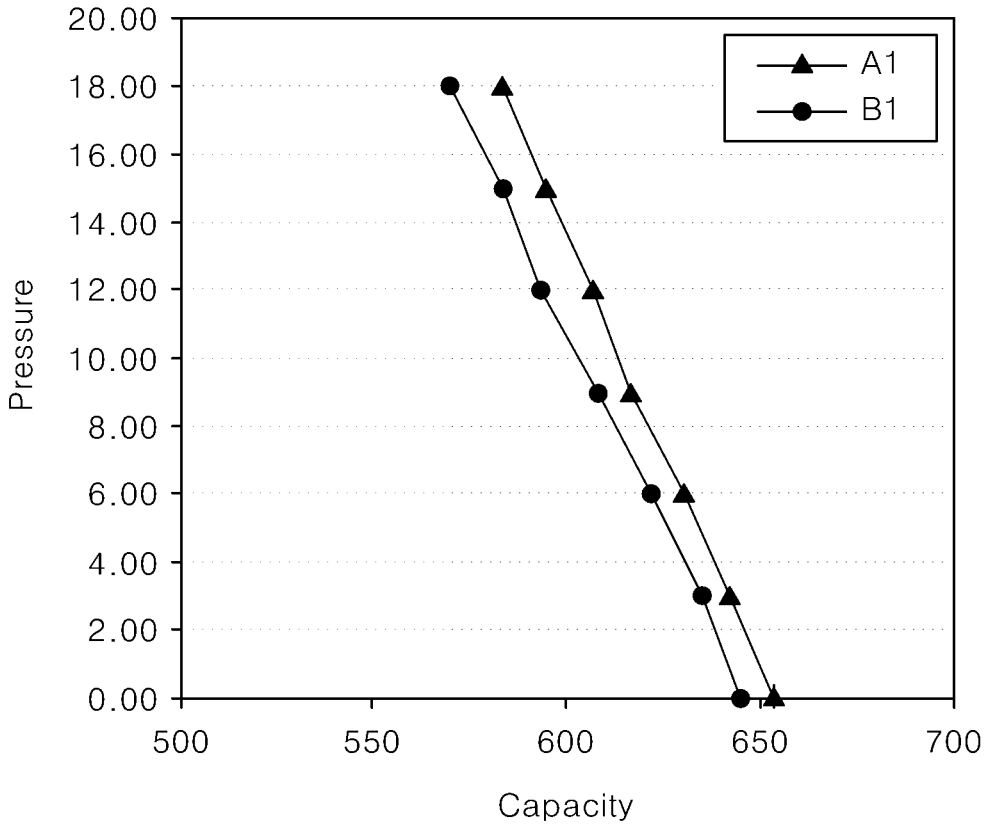
FIG. 8 is a graph showing results obtained by comparing suction performances between a blower in a local ventilation equipment according to an exemplary embodiment of the present disclosure and an existing blower.
Figure 9:
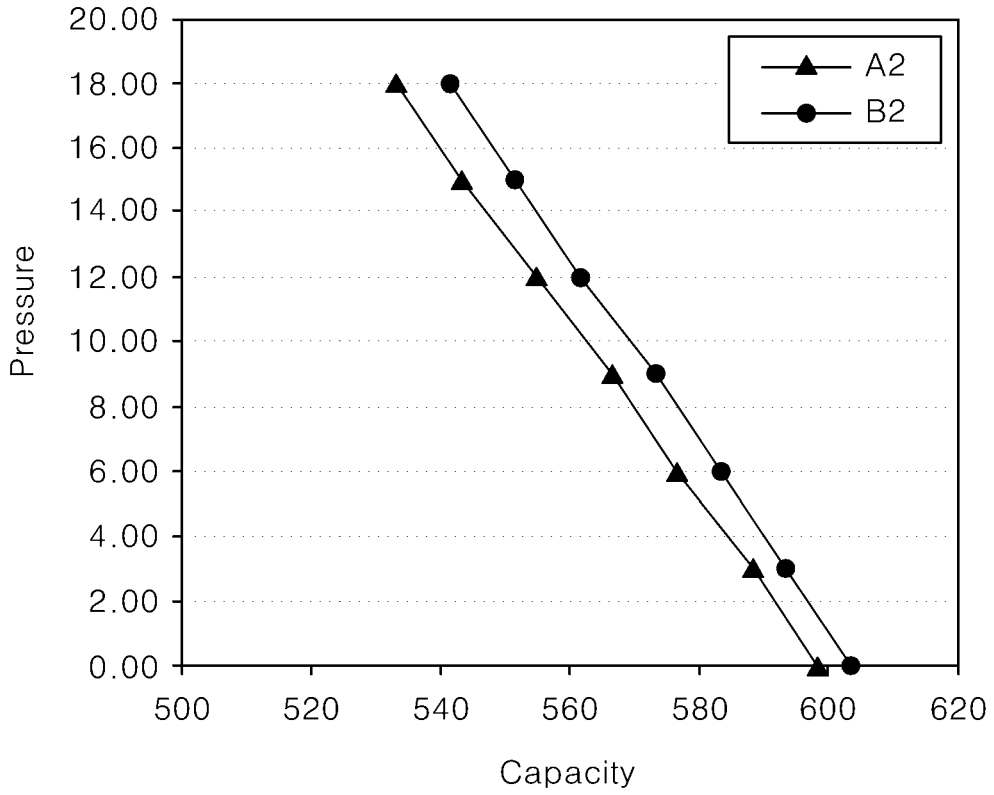
FIG. 9 is a graph showing results obtained by comparing suction performances between a local ventilation equipment according to an exemplary embodiment of the present disclosure and an existing local ventilation equipment employing a blower.

FIG. 8 is a graph showing results obtained by comparing suction performances between a blower in a local ventilation equipment according to an exemplary embodiment of the present disclosure and an existing blower. FIG. 9 is a graph showing results obtained by comparing suction performances between a local ventilation equipment according to an exemplary embodiment of the present disclosure and an existing local ventilation equipment employing a blower. The graph shown in FIG. 9 shows results obtained from a test for measuring the volume of the air sucked by the blower in which the driving unit is installed outside the scroll housing and the volume of the air sucked by the blower in which the driving unit is installed inside the impeller.

The tests were conducted to measure the volume of the air at the exhaust port of the blower when the impeller rotates, with the impeller having the diameter of 165.0 mm and the current input to the driving unit of 1.5 A. The other conditions except for the installation position of the driving unit were the same.

In the test for measuring the volume of the air sucked by the blower alone, the volume of the air sucked by the blower according to the exemplary embodiment of the present disclosure A1 was higher than that of the existing blower B1 by approximately 1 to 2% (see FIG. 8).

In the test for measuring the volume of the air sucked by the blower when it is installed in the local ventilation equipment, the volume of the air sucked by the blower according to the exemplary embodiment of the present disclosure A2 was higher than that of the existing blower B2 by approximately 1 to 2% (see FIG. 9).

That is, it can be seen from the results of the tests that the blower 200 according to the exemplary embodiment of the present disclosure in which the driving unit 230 is installed outside the scroll housing 210 exhibits comparable and even better suction performance compared to the existing blower in which the driving unit is installed inside the impeller.

When the blower 200 is configured such that the driving unit 230 is installed outside the scroll housing 210 as in the exemplary embodiment of the present disclosure, the driving unit 230 may work as resistance to suction. This is because the driving unit 230 may act as a structure that obstructs the flow of air introduced into the blower 200 through the scroll housing 210. If the resistance to suction becomes large, then the suction performance of the blower 200 may be deteriorated.

On the other hand, when the blower is configured such that the driving unit is installed inside the impeller, the volume inside the impeller is reduced as much as the space occupied by the driving unit. As the volume inside the impeller is reduced, the volume that the impeller can actually accommodate air is reduced, which deteriorates the suction performance of the blower.

That is, whether the driving unit 230 is installed outside the scroll housing 210 or inside the impeller 220, the suction performance of the blower 200 due to the presence of the driving unit 230 is inevitable.

Therefore, if the blower 200 having the driving unit 230 installed outside the scroll housing 210 exhibits comparable or even better suction performance compared to the blower having the driving unit 230 installed inside the impeller, it is worth considering the structure in which the driving unit 230 is installed outside the scroll housing 210.

It can be seen from the results of the tests that the blower 200 according to the exemplary embodiment of the present disclosure exhibits improved suction performance as compared to the existing blower.

The reasons for the improved suction performance are as follows:

First, in the blower 200 according to the exemplary embodiment of the present disclosure, the driving unit 230 is not installed in the impeller 220 such that there is sufficient volume in the impeller 220 to accommodate air.

In the structure in which the driving unit is installed inside the impeller, the volume for actually accommodating the air in the impeller is reduced, so that the suction performance of the blower is lowered. In addition, there is the volume difference between two spaces in the impeller divided by the hub because the driving unit is installed in one of the two spaces, such that the volume of the air is uneven, resulting vibration and noise.

In contrast, in the blower 200 according to the exemplary embodiment of the present disclosure, the driving unit 230 is not installed inside the impeller 220, that thus there is sufficient volume for actually accommodating air inside the impeller 220. In addition, there is no issue of uneven volume between the two spaces divided by the hub 221.

Therefore, the blower 200 according to the exemplary embodiment of the present disclosure is capable of providing an improved suction performance by ensuring sufficient volume for actually accommodating the air inside the impeller 220, and is also capable of preventing vibration and noise issues.

Second, in the blower 200 according to the exemplary embodiment of the present disclosure, the driving unit 230 is coupled with the mounting portion 240 is installed outside the scroll housing 210, spaced apart from the outer circumferential surface of the scroll housing 210, so that a passage connecting the suction hole 210*a* to the outside of the blower 200 is formed between the driving unit 230 and the scroll housing 210.

Therefore, even if the driving unit 230 is installed outside the scroll housing 210 and blocks the scroll housing 210, the passage is formed between the driving unit 230 and the scroll housing 210, which has a sufficient width to allow the air to flow from the outside the scroll housing 210 toward the suction hole 210. Accordingly, it is possible to substantially reduce the resistance to suction resulted from the driving unit 230 installed outside the scroll housing 210.

Accordingly, although resistance to suction is increased as the driving unit 230 is installed outside the scroll housing 210, it can be offset by the passage, and consequently, the overall resistance of the blower 200 can be reduced.

Accordingly, the blower 200 according to the exemplary embodiment of the present disclosure can have the driving unit 230 installed outside the scroll housing 210 while reducing noise and vibration and improving suction performance compared to existing blowers.

As described above, in the blower 200 and the local ventilation equipment 1 having the same as shown in FIGS. 1 to 3, the driving unit 230 is installed outside the scroll housing 210, thereby providing the following advantages:

First, in the blower 200 and the local ventilation equipment 1 according to the exemplary embodiment of the present disclosure, the driving unit 230 is installed outside the impeller 220 and thus there is no possibility that the driving unit 230 interferes with the impeller 220. Accordingly, it is possible to employ a type of driving unit 230 manufactured for general purpose for various types of blowers having different sizes of the impeller 220 without any additional design change.

Second, by employing a type of driving unit 230 manufactured for general purpose for various types of blowers having different sizes of the impeller 220 without any additional design change, the blower 200 and the local ventilation equipment 1 according to the exemplary embodiment of the present disclosure can save time and cost invested for the design change of the motor and can improve the compatibility of the motor for blowers.

Third, in the blower 200 and the local ventilation equipment 1 having the same according to the exemplary embodiment of the present disclosure, the driving unit 230 is not installed inside the impeller 220 and the passage having a sufficient width is formed between the driving unit 230 and the scroll housing 210, thereby reducing noise and vibration while improving suction performance.

Although the exemplary embodiments of the present disclosure have been described with reference to the accompanying drawings, these are merely illustrative. It will be appreciated by those skilled in the art that various modifications and equivalents are possible without departing from the scope of the present disclosure. Accordingly, the true scope sought to be protected is defined solely by the claims.

What is claimed is:

1. Ventilation equipment comprising:

a main body that includes (i) a first intake port in a first portion of the main body and (ii) an interior area of the main body; and a blower that is located in the interior area of the main body and that is configured to generate air flow from an exterior area of the main body into the interior area of the main body through the first intake port, wherein the blower includes:

an impeller that is configured to rotate about a rotation shaft extending in a first direction, the impeller including an interior area to which air flows through an opening of the impeller, a scroll housing that accommodates the impeller and that includes a first surface defining a suction hole through which air flows from an exterior area of the scroll housing into the interior area of the impeller, the scroll housing having a cylindrical shape with open sides, a mounting portion that is located at the first surface of the scroll housing, the mounting portion including a plurality of support members that are integrally formed with the scroll housing, that are arranged along a circumference of the scroll housing, and that are spaced apart from one another, a driving unit that is coupled to the mounting portion, that is disposed outside the impeller, and that is disposed between the main body and the scroll housing, the driving unit being configured to rotate the impeller, wherein each of the support members extends from an outer circumferential surface of the scroll housing toward a center of the suction hole, and is coupled to the driving unit at a position closer to the center of the suction hole than to the outer circumferential surface of the scroll housing, wherein the drive unit includes:

a rotor and a stator, a motor case that has a flat hexahedral shape, the motor case including (i) a case body that has a flat cylindrical shape, that is disposed at a center region of the motor case, and that accommodates the rotor and stator therein, and (ii) a plurality of coupling parts that are disposed at an edge of the case body, that are integrally formed with the case body, and that couple the case body to the support members at the position closer to the center of the suction hole than to the outer circumferential surface of the scroll housing, and a shaft that connects between the impeller and the rotor, wherein a length of each of the plurality of coupling parts in the first direction is shorter than a length of the case body in the first direction, and wherein the case body is disposed at a position corresponding to an inside of the suction hole, and protrudes toward an inner surface of the scroll housing relative to an outermost part of the support members facing the inner surface of the scroll housing.

2. The equipment of claim 1, wherein the driving unit includes a brushless direct current (BLDC) motor.

3. The equipment of claim 1, wherein a length of the motor case in a second direction is shorter than a length of a gap between the main body and the scroll housing.

4. The equipment of claim 1, wherein the blower further includes:

a mounting portion that is located on a first surface of the scroll housing, wherein the suction hole is located on the first surface of the scroll housing, and wherein the driving unit is coupled to the mounting portion and is located outside the scroll housing.

5. The equipment of claim 1, wherein the driving unit is located at a first position and, in a state in which the driving unit is located at the first position, a space exists between the driving unit and a second surface of the scroll housing.

6. The equipment of claim 5, wherein, in the state in which the driving unit is located at the first position, air flows from the first intake port to the suction hole through a space between the driving unit and the scroll housing.

7. The equipment of claim 1, wherein the suction hole is oriented in a third direction and the first intake port is oriented in a fourth direction, and wherein the third direction is perpendicular to the fourth direction.

8. The equipment of claim 1, wherein the main body further includes:

a second intake port that is located at a second portion of the main body and through which air flows from the exterior area of the main body into the interior area of the main body.

9. The equipment of claim 1, wherein the blower further includes:

an outlet through which air flows from the interior area of the main body to the exterior area of the main body.

10. A blower comprising:

an impeller that is configured to rotate about a rotation shaft extending in a first direction, the impeller including an interior area to which air flows through an opening of the impeller;

a scroll housing that accommodates the impeller and that includes a first surface defining a suction hole of the scroll housing through which air flows from an exterior area of the scroll housing into the interior area of the impeller, the scroll housing having a cylindrical shape with open sides;

a mounting portion that is located at the first surface of the scroll housing, the mounting portion including a plurality of support members that are integrally formed with the scroll housing, that are arranged along a circumference of the scroll housing, and that are spaced apart from one another; and a driving unit that is coupled to the mounting portion, that is located outside the scroll housing, and that is disposed outside the impeller, the driving unit being configured to rotate the impeller, wherein each of the support members extends from an outer circumferential surface of the scroll housing toward a center of the suction hole, and is coupled to the driving unit at a position closer to the center of the suction hole than to the outer circumferential surface of the scroll housing, wherein the drive unit includes:

a rotor and a stator, a motor case that has a flat hexahedral shape, the motor case including (i) a case body that has a flat cylindrical shape, that is disposed at a center region of the motor case, and that accommodates the rotor and stator therein, and (ii) a plurality of coupling parts that are disposed at an edge of the case body, that are integrally formed with the case body, and that couple the case body to the support members at the position closer to the center of the suction hole than to the outer circumferential surface of the scroll housing, and a shaft that connects between the impeller and the rotor, wherein a length of each of the plurality of coupling parts in the first direction is shorter than a length of the case body in the first direction, and wherein the case body is disposed at a position corresponding to an inside of the suction hole, and protrudes toward an inner surface of the scroll housing relative to an outermost part of the support members facing the inner surface of the scroll housing.

11. The blower of claim 10, wherein the driving unit is installed spaced apart from the outer circumferential surface of the scroll housing so that a passage connecting the suction hole to outside of the blower is formed between the driving unit and the scroll housing.

12. The blower of claim 11, wherein the driving unit includes a brushless direct current (BLDC) motor.

13. The blower of claim 12, wherein a length of the motor case in the first direction is shorter than a length of a part of the shaft that protrudes from the motor case.

* * * * *